US009279320B2

(12) United States Patent
Jacobs et al.

(10) Patent No.: US 9,279,320 B2
(45) Date of Patent: Mar. 8, 2016

(54) DOWNHOLE TOOL HOUSING

(75) Inventors: Peter Jacobs, Madeley (AU); Kelvin Brown, Sorrento (AU)

(73) Assignee: Reflex Technology International Pty Ltd., Balcatta, Western Australia (AU)

( * ) Notice: Subject to any disclaimer, the term of this patent is extended or adjusted under 35 U.S.C. 154(b) by 620 days.

(21) Appl. No.: 13/201,253

(22) PCT Filed: Feb. 12, 2010

(86) PCT No.: PCT/AU2010/000151
§ 371 (c)(1),
(2), (4) Date: Oct. 24, 2011

(87) PCT Pub. No.: WO2010/091471
PCT Pub. Date: Aug. 19, 2010

(65) Prior Publication Data

US 2012/0031681 A1 Feb. 9, 2012

(30) Foreign Application Priority Data

Feb. 12, 2009 (AU) ..... 2009900590

(51) Int. Cl.

| | |
|---|---|
| ***E21B 17/18*** | (2006.01) |
| ***E21B 25/00*** | (2006.01) |
| ***E21B 47/01*** | (2012.01) |
| ***E21B 25/16*** | (2006.01) |

(52) U.S. Cl.
CPC ..... *E21B 47/01* (2013.01); *E21B 17/18* (2013.01); *E21B 25/16* (2013.01)

(58) Field of Classification Search
CPC ..... E21B 21/103; E21B 17/18; E21B 27/02; E21B 25/00
USPC ..... 166/133, 185, 186, 325, 334.3; 175/317, 239
See application file for complete search history.

(56) References Cited

U.S. PATENT DOCUMENTS

| | | | | | |
|---|---|---|---|---|---|
| 474,080 | A | * | 5/1892 | Bullock et al. | 175/239 |
| 1,493,112 | A | * | 5/1924 | Elliott | 175/387 |
| 1,563,837 | A | * | 12/1925 | Crum | 175/239 |
| 1,614,199 | A | * | 1/1927 | Jones et al. | 175/235 |

(Continued)

FOREIGN PATENT DOCUMENTS

| | | |
|---|---|---|
| SU | 956743 | 9/1982 |
| WO | WO 96/04459 | 2/1996 |
| WO | WO 2006/024111 | 3/2006 |

OTHER PUBLICATIONS

International Search Report for Application No. PCT/AU2010/000151 mailed Apr. 7, 2010.

(Continued)

*Primary Examiner* — Cathleen Hutchins
(74) *Attorney, Agent, or Firm* — Merchant & Gould P.C.

(57) ABSTRACT

A housing (15) for connection to a downhole assembly (17), the housing comprising first and second sections (31, 32), the first section (31) being adapted for connection to a portion of the downhole assembly, the second section (32) defining a compartment (23) to receive a downhole tool (11) or component thereof, the second section (32) being configured to provide a path (40) for fluid flow past the compartment (23) as the assembly descends within the borehole, and the first section (31) being configured for fluid communication between a passage in said portion of the downhole assembly and the fluid flow path (40).

21 Claims, 9 Drawing Sheets

(56) References Cited

U.S. PATENT DOCUMENTS

| | | | | | |
|---|---|---|---|---|---|
| 1,629,026 | A | * | 5/1927 | Dye | 175/239 |
| 1,818,981 | A | * | 8/1931 | Anderson | 175/235 |
| 2,001,764 | A | * | 5/1935 | Leonard | 175/239 |
| 2,035,887 | A | * | 3/1936 | Howard | 175/237 |
| 2,313,576 | A | | 3/1943 | Phillips et al. | |
| 3,955,633 | A | | 5/1976 | Bowles et al. | |
| 5,230,390 | A | * | 7/1993 | Zastresek et al. | 175/232 |
| 6,644,421 | B1 | | 11/2003 | Long | |

OTHER PUBLICATIONS

European Search Report for EP Application No. 10 740 846 mailed Apr. 7, 2014 (5 pages).
European Extended Search Report in Application 10740846.0, mailed Apr. 7, 2014, 5 pgs.
European Exam Report in Application 10740846.0, mailed Feb. 24, 2015, 6 pgs.

* cited by examiner

DOWNHOLE TOOL HOUSING

This application is a National Stage Application of PCT/AU2010/000151, filed 12 Feb. 2010, which claims benefit of Serial No. 2009900590, filed 12 Feb. 2009 in Australia and which applications are incorporated herein by reference. To the extent appropriate, a claim of priority is made to each of the above disclosed applications.

FIELD OF THE INVENTION

This invention relates to geological investigative operations (including core sampling and orientation) and more particularly to an assembly for deploying an instrument, or component thereof, used in such an investigation within a borehole. The invention also relates to a housing which can be incorporated in such an assembly and which can accommodate an instrument, or a component thereof, used in a geological investigation.

BACKGROUND ART

The following discussion of the background art is intended to facilitate an understanding of the present invention only. The discussion is not an acknowledgement or admission that any of the material referred to is or was part of the common general knowledge as at the priority date of the application.

Certain geological investigative operations involve drilling boreholes from which core samples are extracted. Analysis of material within the core samples provides geological information in relation to the underground environment from which the core sample has been extracted. Typically, it is necessary to have knowledge of the orientation of each core sample relative to the underground environment from which it has been extracted. For this purpose, it is usual to use an orientation device for providing an indication of the origination of the core sample.

Core drilling is typically conducted with a core drill fitted as a bottom end assembly to the bottom end of a series of drill rods. The core drill comprises an outer tube which is connected to the bottom end of the series of drill rods and an inner tube which is known as a core tube. A cutting head is attached to the outer tube so that rotational torque applied to the outer tube is transmitted to the cutting head. A core is generated during the drilling operation, with the core progressively extending into the core tube as drilling progresses. When the core tube is full or becomes blocked, the core tube is retrieved from within the drill hole, typically by way of a retrieval cable lowered down the drill rods. Once the core tube has been brought to ground surface, the core sample can be removed and subjected to the necessary analysis.

There are various proposals for attachment of the orientation device, or a downhole component thereof, to the core tube. One such proposal is disclosed in the applicant's international application WO 2006/024111, the contents of which are incorporated herein by way of reference.

The core tube and the orientation device, or a downhole component thereof, provides an assembly that is deployed within the outer tube. For this purpose, the assembly must descend within the drill rods to the outer tube, passing through fluid (such as drilling mud) contained within the drill rods. As the assembly descends, it is necessary for fluid within the drill rods to flow past the descending assembly. The fluid can easily flow through the core tube because of its construction, but the presence of the orientation device, or downhole component thereof, can provide an impediment to fluid flow. This can retard the rate of descent of the assembly, which can be undesirable as it prolongs the overall time required for the core sampling operation. Indeed, it is most desirable that the assembly be able to descend within the drill rods relatively rapidly so that time is not unnecessarily wasted during this stage the core sampling operation.

It is against this background, and the problems and difficulties associated therewith that the present invention has been developed.

While the background of the invention has been described in relation to deployment of a core sample orientation device, or a downhole component thereof, it should be understood that the invention may be applicable to deployment of any appropriate device within a borehole.

DISCLOSURE OF THE INVENTION

According to a first aspect of the invention there is provided a housing for connection to a downhole assembly, the housing comprising first and second sections, the first section being adapted for connection to a portion of the downhole assembly, the second section defining a compartment to receive a downhole tool or component thereof, the second section being configured to provide a path for fluid flow past the compartment as the assembly descends within the borehole, and the first section being configured for fluid communication between a passage in said portion of the downhole assembly and the fluid flow path.

The first section may comprise a cavity for communication with the passage within the said portion, and one or more ports extending between the cavity and the fluid path to provide for fluid communication between the passage in the said portion and the fluid flow path.

Preferably, the housing further comprises a third section spaced from the first section, with the second section disposed between the first and third sections.

Preferably, the third section is adapted for connection to a further portion of the downhole assembly in which there is a further passage, the third section being configured for fluid communication between the fluid flow path and the further passage.

The third section may comprise a cavity for communication with the further passage within the further portion of the assembly and one or more ports extending between the fluid flow path and the cavity to provide for the fluid communication between the communication path and the passage in the further tubular portion.

The housing may comprise at least two parts adapted for connection together and selectively separable to provide access to the compartment.

Preferably, a valve means is provided to permit fluid in the borehole (or more particularly the drill rods) to flow past the assembly as the latter descends within the borehole while inhibiting fluid flow past the assembly as the latter ascends within the borehole.

The valve means may comprise a check valve such as a ball check valve.

The valve means may be associated with the first section of the housing.

The downhole tool, or component thereof, may be of any appropriate form. An example of such a tool is an orientation device for providing an indication of the orientation of a core sample cut by a core drill in geological investigative operations.

According to a second aspect of the invention there is provided a housing adapted for connection to a tubular portion in a downhole assembly, the tubular portion having an axial passage through which fluid in a borehole can pass as the assembly descends within the borehole, and the housing comprising first and second sections, the first section being adapted for connection to the tubular portion, the second section defining a compartment to receive a downhole tool or component thereof, the second section being configured to provide a path for fluid flow past the compartment as the assembly descends within the borehole, and the first section being configured for fluid communication between the axial passage in the tubular portion and the fluid flow path.

According to a third aspect of the invention there is provided a housing adapted for connection to a core drill inner tube, the inner tube having an axial passage through which fluid in a borehole can pass as the inner tube and housing connected thereto descend within the borehole, the housing comprising first, second and third sections, the first section being adapted for connection to the inner tube, the second section defining a compartment to receive a core sample measurement device or component thereof, the second section being configured to provide a path for fluid flow past the compartment as the inner tube and housing connected thereto descend within the borehole, and the first section being configured for fluid communication between the axial passage in the inner tube and the fluid flow path, the third section being spaced from the first section, with the second section disposed between the first and third sections, the third section being adapted for connection to a portion of a downhole assembly in which there is a further passage, the third section being configured for fluid communication between the fluid flow path and the further passage.

The third section may comprise a cavity for communication with the further passage within the further portion of the assembly and one or more ports extending between the fluid flow path and the cavity to provide for the fluid communication between the communication path and the passage in the further tubular portion.

According to a fourth aspect of the invention there is provided an assembly movable along a borehole, the assembly comprising a tubular portion and a housing connected to the tubular portion, the tubular portion having an axial passage through which fluid in the borehole can pass as the assembly descends within the borehole, and the housing comprising first and second sections, the first section being connected to the tubular portion, the second section defining a compartment to receive a downhole tool or component thereof, the second section being configured to provide a path for fluid flow past the compartment as the assembly descends within the borehole, and the first section being configured for fluid communication between the axial passage in the tubular portion and the fluid flow path.

Typically, the assembly is movable along a series of drill rods located within the borehole.

With this arrangement, fluid in the borehole (or more particularly within the drill rods), can flow past the assembly as the latter descends, notwithstanding the presence of the borehole tool in the assembly. Preferably, the arrangement is such that the fluid can flow past the assembly at a rate sufficient to allow the assembly to descent rapidly.

Preferably, the fluid flow path is defined by a space within the borehole (or more particularly within the drill rods) around the second section of the housing portion. With such an arrangement, the second portion defines the inner boundary of the fluid flow path. Other arrangements are, of course, possible. In another arrangement, for example, the fluid flow path may comprise one or more flow passages incorporated in the second section to allow fluid flow past the second section.

The first section may comprise a cavity communicating with the axial passage within the tubular portion and one or more ports extending between the cavity and the fluid path to provide for fluid communication between the axial passage in the tubular portion and the fluid flow path.

Preferably, the housing further comprises a third section spaced from the first section with the second section disposed between the first and third sections.

Preferably, the third section is connected to a further portion of the assembly in which there is a further axial passage through which fluid in the borehole (or more particularly the drill rods) can pass as the assembly descends, the third section being configured for fluid communication between the fluid flow path and the further axial passage.

The third section may comprise a cavity communicating with the further axial passage within the further portion of the assembly and one or more ports extending between the fluid flow path and the cavity to provide for the fluid communication between the communication path and the further axial passage in the further tubular portion.

Preferably, a valve means is provided to permit fluid in the borehole (or more particularly the drill rods) to flow past the assembly as the latter descends within the borehole while inhibiting fluid flow past the assembly as the latter ascends within the borehole.

According to a fifth aspect of the invention there is provided a housing for an assembly according to the fourth aspect of the invention, the housing being as described above.

According to a sixth aspect of the invention there is provided a core drill assembly movable along a borehole, the assembly comprising a core drill inner tube and a housing connected to the inner tube, the inner tube having an axial passage through which fluid in the borehole can pass as the assembly descends within the borehole, and the housing comprising first and second sections, the first section being connected to the inner tube, the second section defining a compartment to receive a core sample measurement device or component thereof, the second section being configured to provide a path for fluid flow past the compartment as the assembly descends within the borehole, and the first section being configured for fluid communication between the axial passage in the tubular portion and the fluid flow path.

According to a seventh aspect of the invention there is provided a core drill assembly movable along a borehole, the assembly comprising a core drill inner tube and a housing connected to the inner tube, the inner tube having an axial passage through which fluid in the borehole can pass as the assembly descends within the borehole, and the housing comprising first, second and third sections, the first section being connected to the inner tube, the second section defining a compartment to receive a core sample measurement device or component thereof, the second section being configured to provide a path for fluid flow past the compartment as the assembly descends within the borehole, the first section being configured for fluid communication between the axial passage in the inner tube and the fluid flow path, the third section being spaced from the first section, with the second section disposed between the first and third sections, the third section being adapted for connection to a portion of the downhole assembly in which there is a further passage, the third section being configured for fluid communication between the fluid flow path and the further passage.

The core sample measurement device may comprise a core sample orientation device, an example of which is disclosed in the applicant's aforementioned international application WO 2006/024111.

BRIEF DESCRIPTION OF THE DRAWINGS

The invention will be better understood by reference to the following description of one specific embodiment thereof as shown in the accompanying drawings in which.

BEST MODE(S) FOR CARRYING OUT THE INVENTION

The embodiment is directed to deployment of a core sample orientation system for providing an indication of the orientation of a core sample relative to the underground environment from which the core sample has been extracted. The core orientation system utilised in this embodiment comprises a first tool portion adapted for connection to a core tube for recording data relative to the orientation of the core tube, and a second tool portion adapted to cooperate with the first tool portion to receive and process orientation data from the first portion and provide an indication of the orientation of the core sample within the core tube at the time of separation of the core sample from the underground environment from which it was obtained. With such an arrangement, the first tool portion is deployed underground in a borehole with the core tube to record data corresponding to the orientation of the core tube (and any core sample contained therein). Once the core tube, along with the first tool portion attached thereto, had been retrieved from underground, the second tool portion is brought into cooperation with the first tool portion to receive and process the orientation data received from the first portion. This arrangement is advantageous as it is not necessary for the second tool portion to be deployed underground and be exposed to the harsh conditions associated with the underground environment. An example of such a core sample orientation system is disclosed in the applicant's Australian Provisional Patent Application 2009900670 entitled "Modular Core Orientation Tool", the contents of which are incorporated herein by way of reference. In such a system, the first portion comprises a downhole unit and the second portion comprises a control unit.

Figure 10:
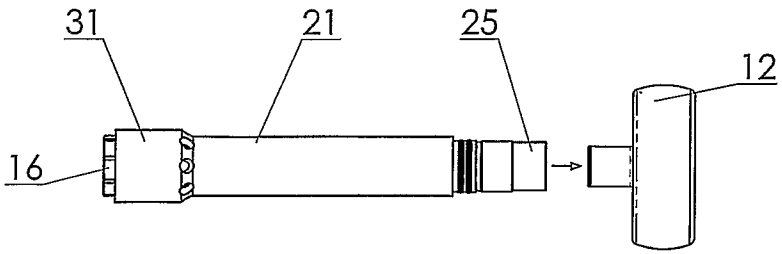
FIG. 10 is a schematic view of one part of the housing, with the other part having been separated therefrom to provide access to a downhole unit accommodated in the first part, and a control unit shown for cooperation with the downhole unit.

In the arrangement illustrated, the first tool portion is identified by reference numeral 11 and the second tool portion is identified by reference numeral 12. The first portion 11 is shown in FIGS. 6 and 8, and the second portion 12 is shown in FIG. 10.

The core drilling operation is performed with a core drill fitted as a bottom end assembly to a series of drill rods. The core drill comprises an inner tube, being the core tube 13, as shown in FIG. 13, and an outer tube.

Figure 6:
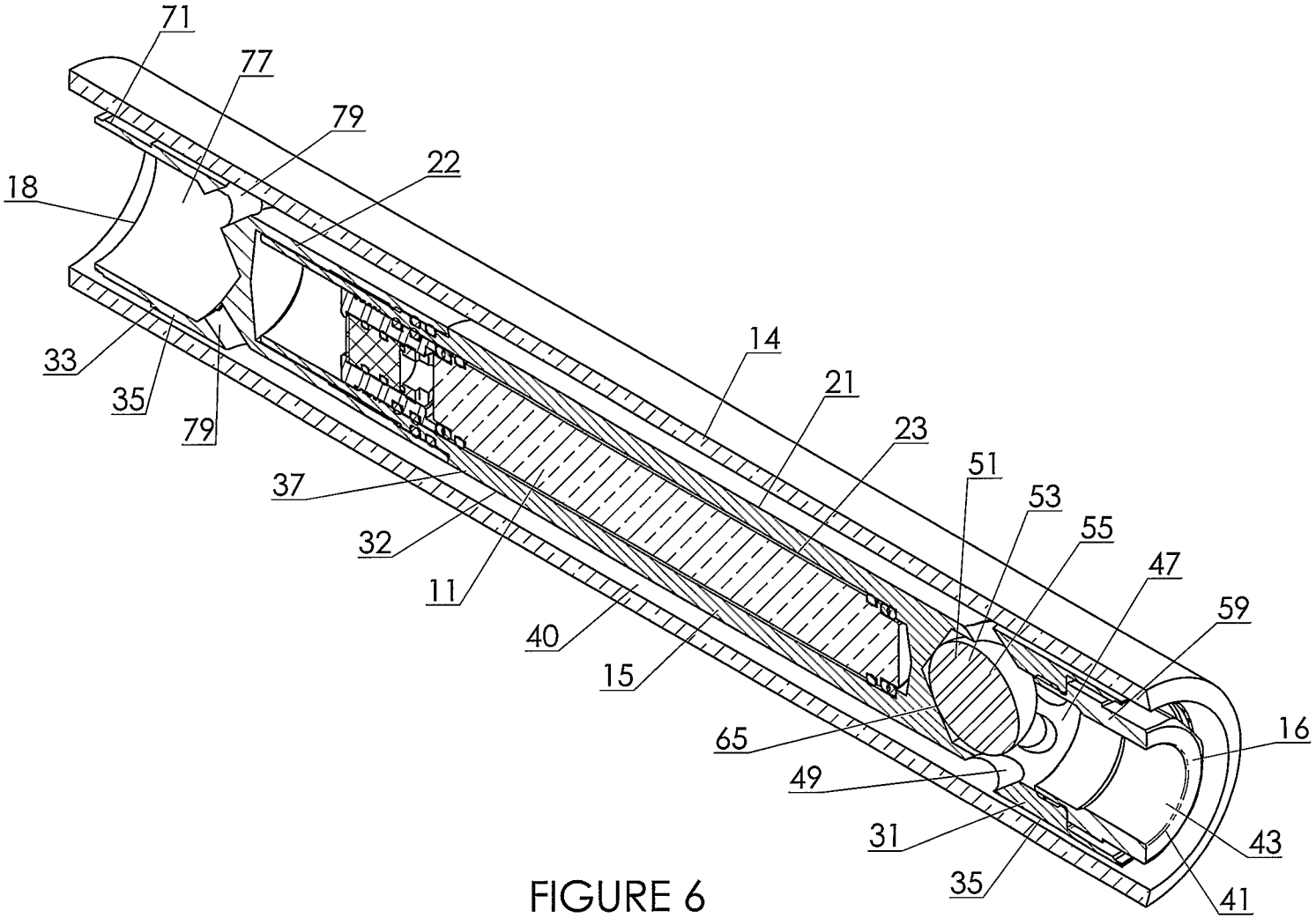
FIG. 6 is a sectional perspective view of the housing within a drill string.
Figure 8:
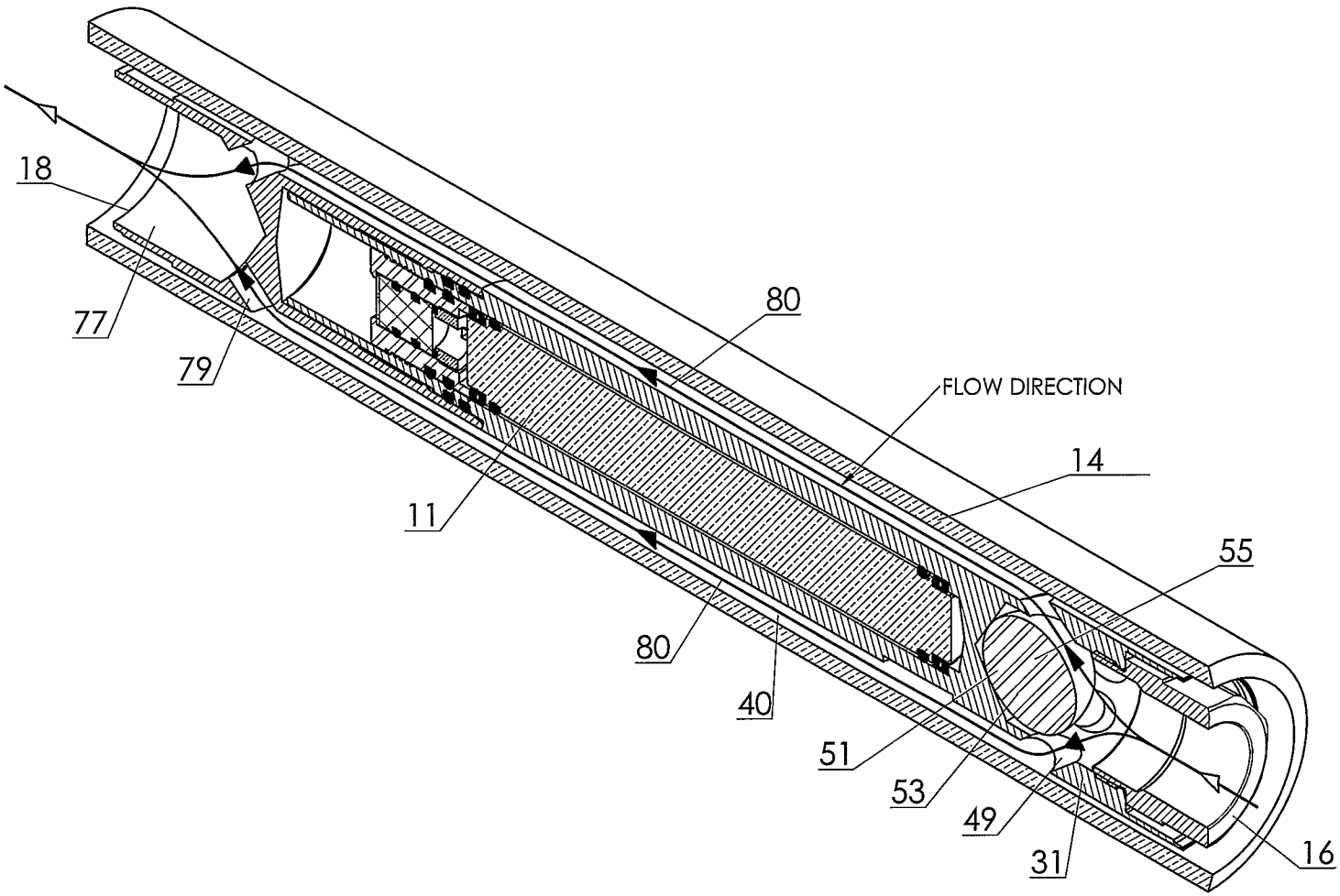
FIG. 8 is a view similar to FIG. 6, except that the flow path of fluid relative to the housing is shown.

The embodiment provides a housing 15 for accommodating the first tool portion 11 as it is deployed within the borehole, as shown in FIGS. 6 and 8.

Figure 9:
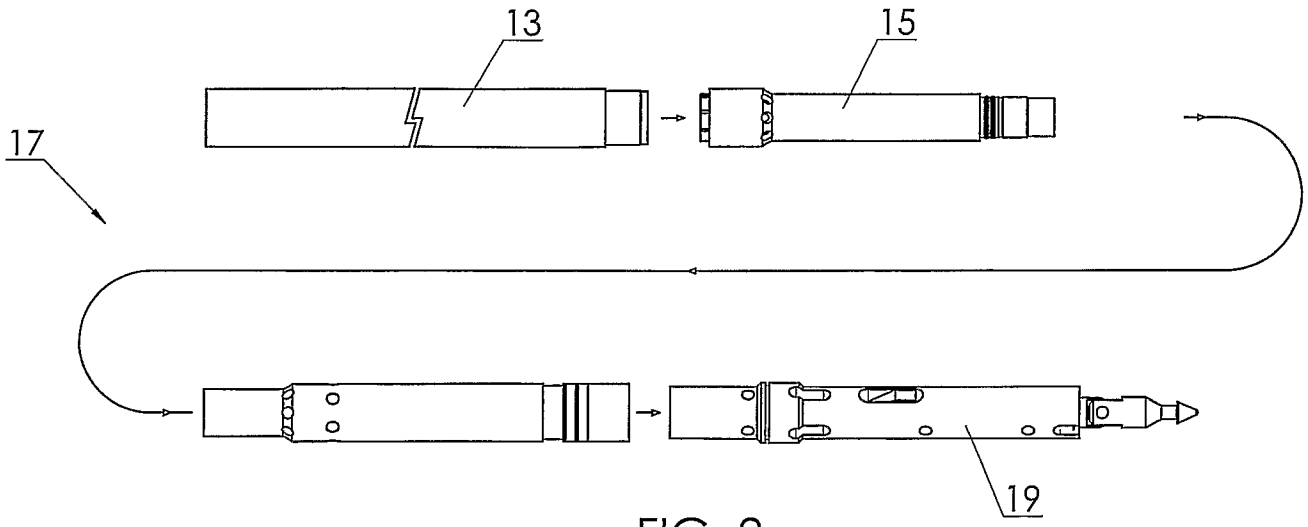
FIG. 9 is a schematic view of an assembly in which the housing is accommodated.

The core tube 13 and the housing 15 form part of an assembly 17, which is shown in FIG. 9 and which also includes a back-end portion 19. The back-end portion 19 is of standard wire line construction and is normally connected directly to core tube 13; however, in this embodiment, the housing 15 is configured for installation between the core tube 13 and the back-end portion 19.

The housing 15 has a bottom end 16 adapted for connection to the upper end of the core tube 13, and an top end 18 adapted for connection to the back-end portion 19, as will be explained.

In this way, the first tool portion 11 is also connected to the core tube 13 so that it record data relative to the orientation of the core tube and any core sample contained therein.

Figure 1:
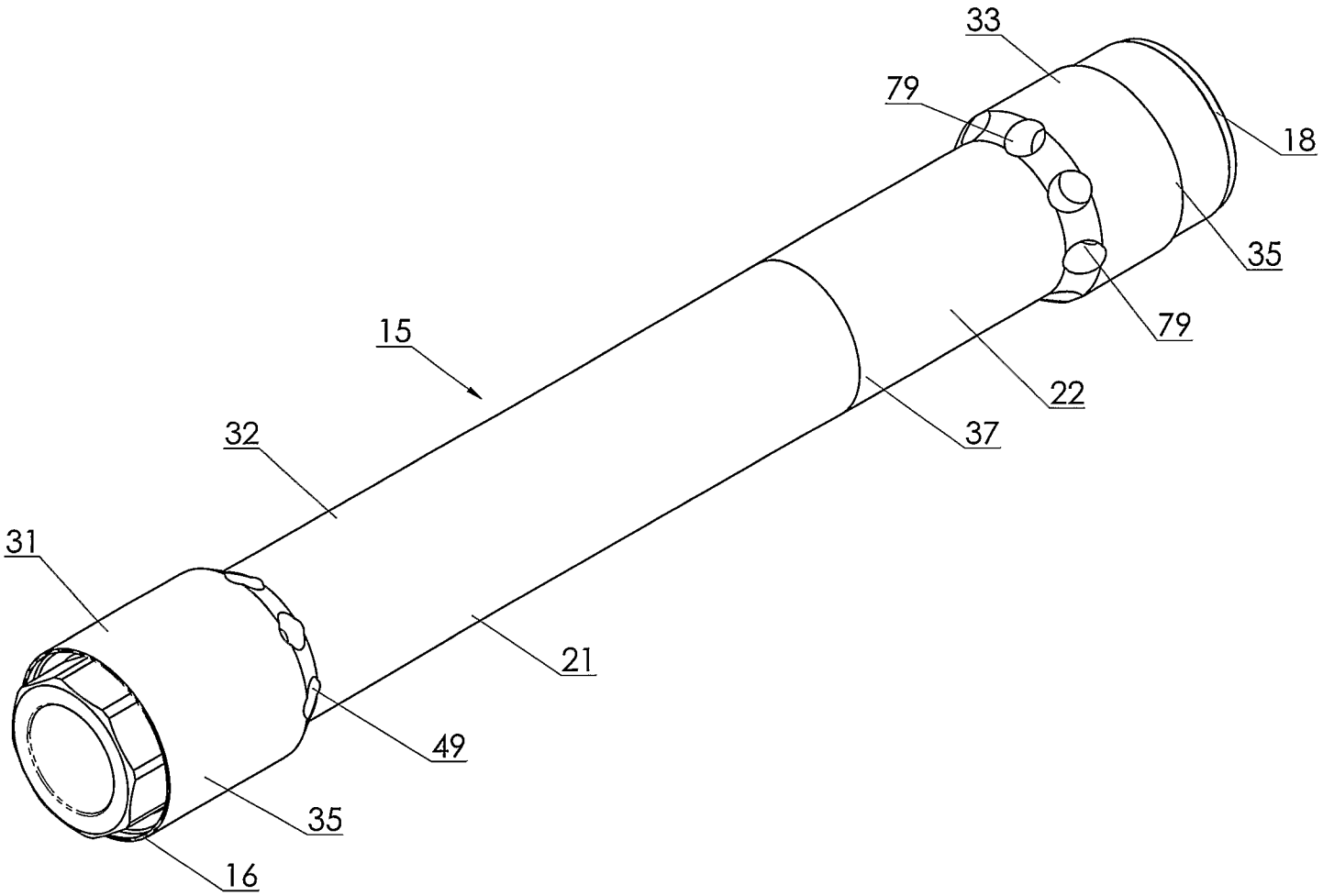
FIG. 1 is perspective view of a housing according to the embodiment, viewed from one end thereof.
Figure 2:
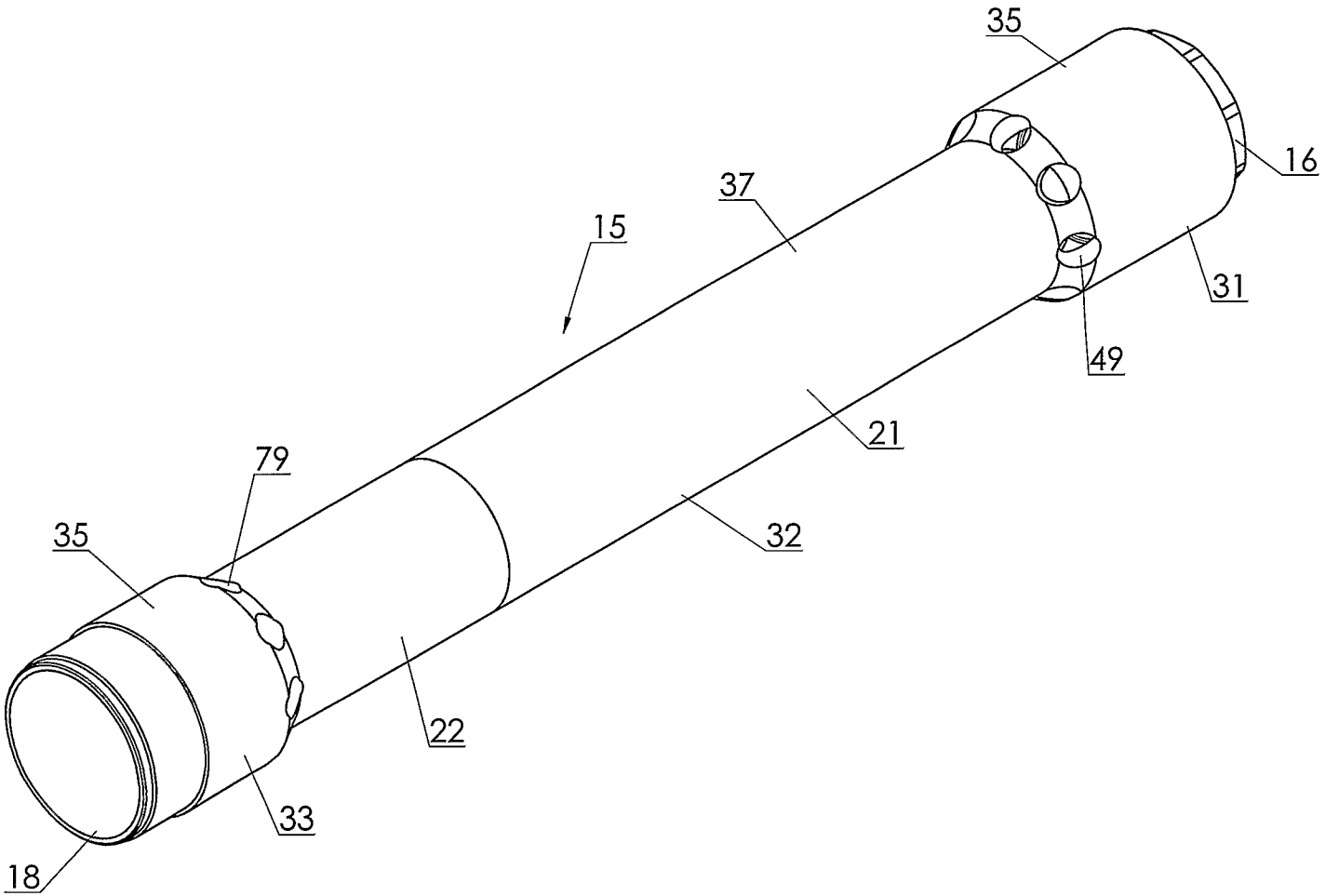
FIG. 2 is a view similar to FIG. 1, except that the housing is viewed from the other end thereof.
Figure 3:
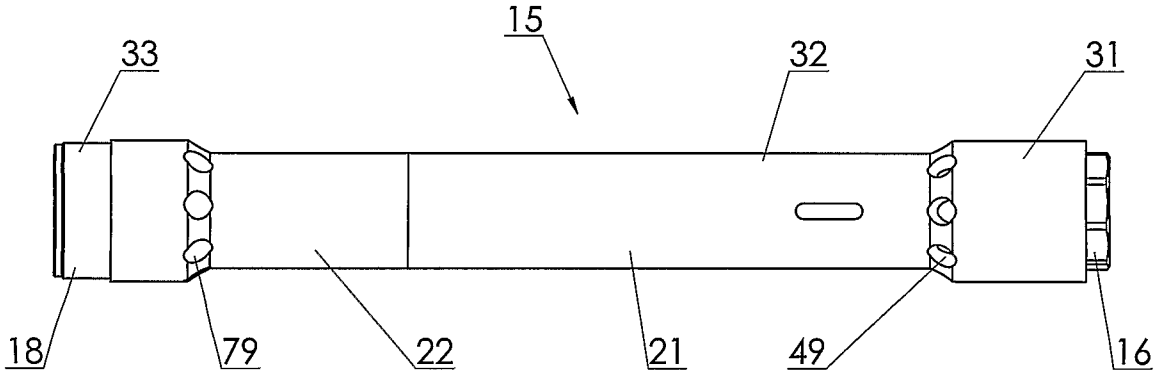
FIG. 3 is a side elevational view of the housing.
Figure 4:
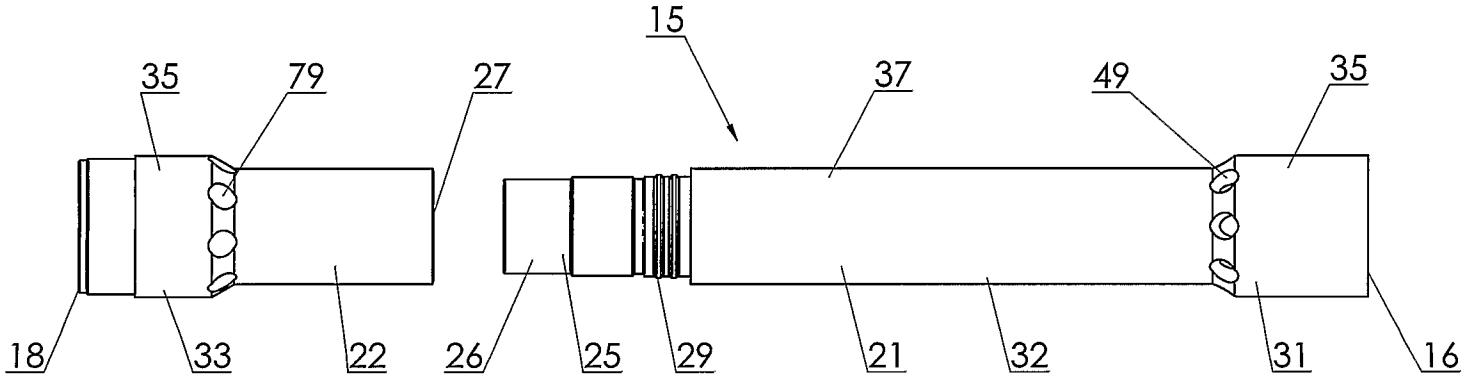
FIG. 4 is a side elevational view of the housing showing the two parts thereof in a separated condition.
Figure 5:
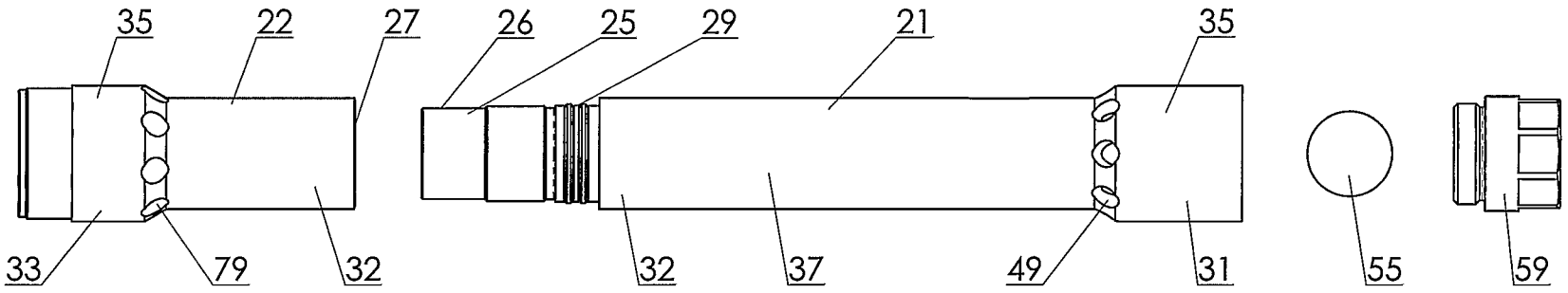
FIG. 5 is a side elevational view of the housing in an exploded condition.
Figure 7:
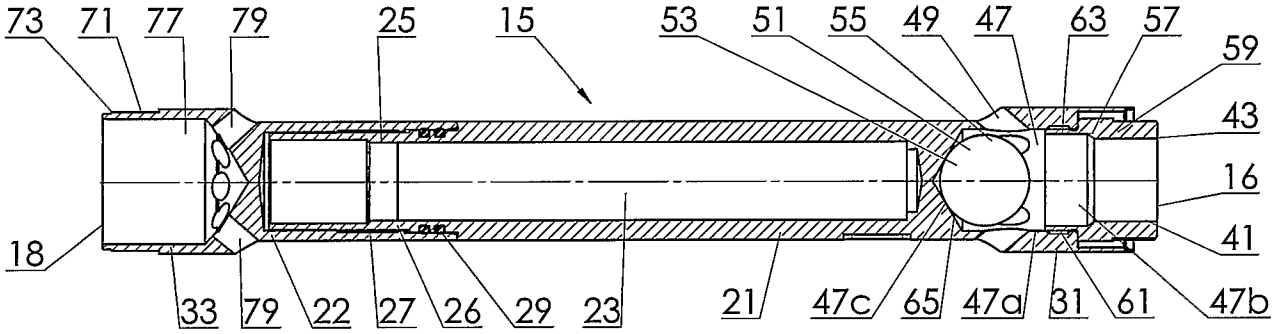
FIG. 7 is a sectional elevational view of the housing

The housing 15 comprises two parts, being lower body part 21 and an upper cap part 22. The two parts 21, 22 cooperate to define an inner compartment 23 adapted to receive and accommodate the first tool portion 11. The compartment is best seen in FIG. 7. The parts 21, 22 are selectively separable to provide access to the compartment 23. In the arrangement illustrated in FIG. 5, the two parts 21, 22 are shown in the separated condition.

The lower body part 21 has an end 25 configured as a spigot 26, and the upper cap portion 22 has an adjacent end configured as a socket 27 in which the spigot 26 can be threadingly received to secure the two parts together. A sealing means 29 is provided to effect fluid-tight sealing engagement between the two parts 21, 22. In the arrangement illustrated, the sealing means 29 comprises O-rings on the spigot 26.

The housing 15 comprises three sections, being a first section 31, a second section 32 and a third section 33. The first and third sections 31, 33 comprise end sections, and the second section 32 comprises an intermediate section between the two end sections.

The two parts 21, 22 cooperate to define the three sections 31, 32, and 33. Specifically, the lower body part 21 defines the first section 31 which constitutes the lowermost section and which terminates at the bottom end. 16. The upper cap part 22 defines the third section 33 which constitutes the uppermost section and which terminates at the top end 18. The lower body part 21 and the upper cap part 22 cooperate to define the intermediate second section 32'.

The two end sections 31, 33 each have a generally circular outer periphery 35. Similarly, the intermediate second section 32 also has a generally circular outer periphery 37. The outer periphery 37 of the intermediate second section 32 is of smaller diameter than the outer peripheries 35 of the two end sections 31, 33. With such an arrangement, an annular space 40 is established around the intermediate second section 32 when the housing 15 is accommodated within the drill rods or the outer tube 14, as shown in FIGS. 6 and 8. The annular space 40 is bounded at its outer periphery by the drill rods or the outer tube 14 and is bounded at its inner periphery by the intermediate section 32.

The first end section 31 is configured for threaded engagement with the adjacent end of the core tube 13. For this purpose, the end section 31 is configured as a threaded coupling 41 having a thread formation 43 for threaded engagement with the adjacent end of the core tube 13 which has a matching threaded coupling. In the arrangement illustrated, the threaded coupling 41 is of female configuration and the threaded formation 43 is a female thread.

The first end section 31 incorporates a cavity 47 for communicating with the interior passage within the core tube 13 when the housing 15 is threadedly connected to the core tube 13. The cavity 47 has a peripheral wall 47*a*, a bottom end 47*b* which is open and which communicates with the bottom end 16 of the housing 15, and a top wall 47*c*.

Further, the first end section 31 is provided with a plurality of ports 49 which extend between the cavity 47 and the exterior of the housing 15 adjacent the intermediate second section 32, as best seen in FIG. 7 of the drawings. With this arrangement, the first end section 31 is configured to provide a fluid flow path between the interior passage of the core tube 13 and the exterior of the housing 15 around the intermediate second section 32 thereof. In the arrangement shown, the ports 49 are circumferentially spaced about the cavity 47, and extend outwardly from the cavity wall 47*a* and upwardly toward the top end 18

The first end section 31 also incorporates a valve means 51 to permit fluid flow from the interior passage of the core tube 13 to the annular space 40 about the intermediate second section 32 of the housing 15, while inhibiting fluid flow in the reverse direction.

The valve means 51 comprises a check-valve in the form of ball check-valve 53. The ball check-valve 53 comprises a spherical valve ball 55 and a valve seat 57 against which the valve ball 55 can sealingly engage. The valve seat 57 is provided around the periphery of the open end 47*b* of the cavity 47. In the arrangement shown, the valve seat 57 is defined within a valve housing 59 connected to an inner portion 61 of the first end section 31. The inner portion 61 is adjacent the cavity 47 and at the bottom entry end 47*b* of the cavity 47, as shown in FIG. 7. The valve housing 59 incorporates a male end 63 for threaded engagement with the inner portion 61. The valve housing 59 cooperates with the inner cavity 47 to provide a cage for retaining valve ball 55 in position. While retained in position, the valve ball 55 is movable into and out of a sealing engagement with the valve seat 57 under the influence of fluid flow in accordance with known ball check-valve operation. The valve housing 59 is also configured to define the threaded coupling 41 having a thread formation 43 at end 16 for threaded engagement with the adjacent end of the core tube 13

The valve means 15 is centrally located within the housing 15 and is sized to optimise fluid flow through the housing 15 to facilitate rapid descent of the assembly 17 in a borehole.

The top wall 47*c* of the cavity 47 is configure to provide a recess 65 into which the valve ball 55 can be received when the check-valve 53 is open during descent of the housing 15. The valve ball 55 received and captively retained in the recess 65 under the influence of fluid flow through the cavity 47 during descent of the housing 15. With this arrangement, the valve ball 55 is constrained by the recess 65 centrally within cavity 47 and away from the ports 49 so as not to impede fluid flow through the cavity 47 to the ports 49.

The valve means 51 is operable to inhibit fluid flow in the reverse direction in order to isolate any core sample contained within the interior passage within the core tube 13 from the effects of fluid flow during ascent of the core tube.

The third end section 33, which is at the top end 18, is configured for threaded engagement with the adjacent end of the back-end portion 19. For this purpose, the third end section 33 is configured as a threaded coupling 71 having a thread formation 73 for threaded engagement with the adjacent end of the back-end portion 19 which has a matching threaded coupling. In the arrangement illustrated, the threaded coupling 71 is of male configuration and the threaded formation 73 is a male thread.

The third end section 33 incorporates a cavity 77 for communicating with the interior of the back-end portion 19 when the housing 15 is threadedly connected to the back-end portion. Further, the third end section 33 is provided with a plurality of ports 79 which extend between the cavity 77 and the exterior of the housing 15 adjacent the intermediate second section 32, as best seen in FIG. 7. With this arrangement, the third end section 33 is configured to provide a fluid flow path between the exterior of the housing 15 around the intermediate second section 32 and the back-end portion 19.

Operation of the assembly 17 will now be described. The housing 15 is installed between the core tube 13 and the back-end portion 19, as previously described to provide the assembly 17.

The two parts 21, 22 of the housing 15 are separated to allow installation of the first tool portion 11 of the orientation device into the compartment 23 and then coupled together to encase the first tool portion within the compartment.

The assembly 17 is then lowered down the drill rods within the borehole in conventional manner. As the assembly 17 descends, fluid within the drill rods flows upwardly (relative to the descending assembly 17) along the interior passage of the core tube 11 and into the valve housing 59, causing the ball valve 55 to move away from the valve seat 57 and allow the fluid flow to enter the cavity 47 within the first end section 31 of the housing 25. From the cavity 47 the fluid flows through the ports 49 and into the annular space 40 surrounding the intermediate second section 32. The fluid flows along the annular space 40 to the ports 79 at the end section 33, from where the fluid flows through the ports 79 and into the central cavity 77. From the central cavity 77 the fluid flows through the hollow interior of the back-end portion 19 in the usual way. The flow path is depicted in FIG. 8 by flow lines identified by reference numeral 80. Thus, the annular space 40 surrounding the intermediate second section 32 provided a fluid flow path between the ports 49 and the ports 79.

With this arrangement, fluid within the drill rods 14 is able to flow past the housing 15 as it descends within the drill rods, and so the presence of the housing 15 does not restrict fluid flow to such an extent to inhibit relatively rapid descent of the assembly 17.

At the completion of the core drilling operation, the core sample is retrieved in known manner. As the assembly 17 ascends within the drill rods, the relative fluid flow causes the valve ball 55 to sealingly engage the valve seat 57 to thereby close the check valve 53.

Once the assembly 17 is at ground level, the two parts 21, 22 of the housing 15 can be separated to provide access to the first tool portion 11. The second tool portion 12 can then be brought into cooperation with the first tool portion 11, as shown in FIG. 10, to receive and process the orientation data received from the first tool portion 11.

Once the orientation of the core sample within the core tube 11 has been established and recorded, the core sample can be removed from the core tube 11. The two parts 21, 22 of the housing 15 can then be brought together again to encase the first tool portion 11 within the housing so that the next core sampling operation can be performed when required.

From the foregoing, it is evident that the present embodiment provides a simple yet highly effective way of enabling fluid to flow past the assembly 17 as it descends within a borehole (or more particularly within the drill rods), thereby facilitating rapid descent.

It should be appreciated that the scope of the invention is not limited to the scope of the embodiment described.

While the embodiment has been described in relation to deployment of a core sample orientation device, or a downhole component thereof, it should be understood that the invention may be applicable to deployment of any appropriate device within a borehole.

Throughout the specification and claims, unless the context requires otherwise, the word "comprise" or variations such as "comprises" or "comprising", will be understood to imply the inclusion of a stated integer or group of integers but not the exclusion of any other integer or group of integers.

The claim defining the invention is as follows:

1. A housing for connection to a downhole assembly adapted to be received within a borehole, the housing comprising a first section, a second section, and a third section, the first section being adapted for connection to a portion of the downhole assembly, the second section defining a compartment to receive a downhole tool or component thereof and the third section being spaced from the first section, with the second section disposed between the first and third sections, the first section having a cavity, at least one outflow port, and a first outer periphery, the second section having a second outer periphery, and the third section having at least one inflow port, a further cavity and a third outer periphery, the second outer periphery being of reduced size with respect to the first and third outer peripheries whereby a space is established around the second section to provide a path for fluid flow around the compartment as the assembly descends within the borehole, the first section being configured for fluid communication between the cavity and the space via the outflow port, and the third section being configured for fluid communication between the space and the further cavity via the inflow port.

2. The housing according to claim 1 wherein the first section comprises a plurality of outflow ports extending between the central cavity and the fluid path to provide for fluid communication between the passage in said portion and the fluid flow path.

3. The housing according to claim 1 wherein the third section is adapted for connection to a further portion of the downhole assembly in which there is a further passage, the third section being configured for fluid communication between the fluid flow path and the further passage.

4. The housing according to claim 3 wherein the further cavity is in communication with the further passage within the further portion of the assembly and the at least one inflow port extends between the fluid flow path and the cavity to provide for the fluid communication between the communication path and the passage in the further portion.

5. The housing according to claim 1, comprising at least two parts adapted for connection together and selectively separable to provide access to the compartment.

6. The housing according to claim 1, further comprising a valve means operable to permit fluid in a borehole to flow past the assembly as the latter descends within the borehole while inhibiting fluid flow past the assembly as the latter ascends within the borehole.

7. The housing according to claim 6 wherein the valve means comprises a check valve.

8. The housing according to claim 6 wherein the valve means is associated with the first section.

9. The housing according to claim 6, wherein the valve means is centrally located and sized to optimise fluid flow through the housing to facilitate rapid descent.

10. A housing adapted for connection to a tubular portion in a downhole assembly adapted to be received in a borehole, the tubular portion having an axial passage through which fluid in the borehole can pass as the assembly descends within the borehole, and the housing comprising a first section, a second section, and a third section, the first section being adapted for connection to the tubular portion, the second section defining a compartment to receive a downhole tool or component thereof, and the third section being spaced apart from the first section, with the second section disposed between the first and third sections, the first section having a cavity, at least one outflow port, and a first outer periphery, the second section having a second outer periphery, and the third section having at least one inflow port, a further cavity, and a third outer periphery, the second outer periphery being of reduced size with respect to the first and third outer peripheries whereby a space is established around the second section to provide a path for fluid flow around the compartment as the assembly descends within the borehole, the first section being configured for fluid communication between the cavity and the space via the outflow port, and the third section being configured for fluid communication between the space and the further cavity via the inflow port.

11. The housing according to claim 10, wherein the third section is adapted for connection to a further portion of the downhole assembly in which there is a further passage, the third section being configured for fluid communication between the fluid flow path and the further passage.

12. A housing adapted for connection to a core drill inner tube adapted to be received in a borehole, the inner tube having an axial passage through which fluid in the borehole can pass as the inner tube and housing connected thereto descend within the borehole, the housing comprising first, second and third sections, the first section being adapted for connection to the inner tube, the second section defining a compartment to receive a core sample measurement device or component thereof, the first section having a cavity, at least one outflow port, and a first outer periphery, the second section having a second outer periphery, and the third section having at least one inflow port, a further cavity, and a third outer periphery, the second outer periphery being of reduced size with respect to the first and third outer peripheries whereby a space is established around the second section to provide a path for fluid flow around the compartment as the inner tube and housing connected thereto descend within the borehole, the first section being configured for fluid communication between the cavity and the space via the outflow port, the third section being spaced from the first section, with the second section disposed between the first and third sections, the third section being adapted for connection to a portion of a downhole assembly in which there is a further passage, the third section being configured for fluid communication between the space and the further cavity and the further passage via the inflow port.

13. The housing according to claim 12 wherein the further cavity is in communication with the further passage within the further portion of the assembly and the at least one inflow port extends between the fluid flow path and the cavity to provide for the fluid communication between the communication path and the passage in the further tubular portion.

14. An assembly movable along a borehole, the assembly comprising the housing according to claim 12.

15. An assembly movable along a borehole, the assembly comprising a tubular portion and a housing connected to the tubular portion, the tubular portion having an axial passage through which fluid in the borehole can pass as the assembly descends within the borehole, and the housing comprising a first section, a second section, and a third section, the first section being connected to the tubular portion, the second section defining a compartment to receive a downhole tool or component thereof, and the third section being spaced from the first section, with the second section disposed between the first and third sections, the first section having a cavity, at least one outflow port, and a first outer periphery, the second section having a second outer periphery, and the third section having at least one inflow port, a further cavity, and a third outer periphery, the second outer periphery being of reduced size with respect to the first and third outer peripheries whereby a space is established around the second section to provide a path for fluid flow around the compartment as the assembly descends within the borehole, and the first section being configured for fluid communication between the cavity and the space via the outflow port, and the third section being configured for fluid communication between the space and the further cavity via the inflow port.

16. The assembly according to claim 15 wherein the first section comprises a plurality of outflow ports extending between the central cavity and the fluid path to provide for fluid communication between the axial passage in the tubular portion and the fluid flow path.

17. The assembly according to claim 15 wherein the third section is connected to a further portion of the assembly in which there is a further axial passage through which fluid in the borehole can pass as the assembly descends, the third section being configured for fluid communication between the fluid flow path and the further axial passage.

18. The assembly according to claim 15 wherein the further cavity is in communication with the further axial passage within the further portion of the assembly and one or more inflow ports extend between the fluid flow path and the cavity to provide for the fluid communication between the communication path and the further axial passage in the further tubular portion.

19. The assembly according to claim 15 further comprising a valve means to permit fluid in the borehole to flow past the assembly as the latter descends within the borehole while inhibiting fluid flow past the assembly as the latter ascends within the borehole.

20. A core drill assembly movable along a borehole, the assembly comprising a core drill inner tube and a housing connected to the inner tube, the inner tube having an axial passage through which fluid in the borehole can pass as the assembly descends within the borehole, and the housing comprising a first section, a second section, and a third section, the first section being connected to the inner tube, the second section defining a compartment to receive a core sample measurement device or component thereof, and the third section being spaced from the first section, with the second section disposed between the first and third sections, the first section having a cavity, at least one outflow port, and a first outer periphery, the second section having a second outer periphery, and the third section having at least one inflow port, a further cavity, and a third outer periphery, the second outer periphery being of reduced size with respect to the first and third outer peripheries whereby a space is established around the second section to provide a path for fluid flow around the compartment as the assembly descends within the borehole, the first section being configured for fluid communication between the cavity and the space via the outflow port, and the third section being configured for fluid communication between the space and the further cavity via the inflow port.

21. A core drill assembly movable along a borehole, the assembly comprising a core drill inner tube and a housing connected to the inner tube, the inner tube having an axial passage through which fluid in the borehole can pass as the assembly descends within the borehole, and the housing comprising first, second and third sections, the first section being connected to the inner tube, the second section defining a compartment to receive a core sample measurement device or component thereof, and the third section being spaced from the first section, with the second section disposed between the first and third sections, the first section having a cavity, at least one outflow port, and a first outer periphery, the second section having a second outer periphery, and the third section having at least one inflow port, a further cavity, and a third outer periphery, the second outer periphery being of reduced size with respect to the first and third outer peripheries whereby a space is established around the second section to provide a path for fluid flow around the compartment as the assembly descends within the borehole, the first section being configured for fluid communication between the cavity and the space via the outflow port, the third section being spaced from the first section, with the second section disposed between the first and third sections, the third section being adapted for connection to a portion of the downhole assembly in which there is a further passage, the third section being configured for fluid communication between the space and the further cavity and the further passage via the inflow port.

* * * * *